US005573614A

United States Patent [19]

Tilman et al.

[11] Patent Number: 5,573,614

[45] Date of Patent: Nov. 12, 1996

[54] METHOD FOR STABILIZING A PLASTIC ZIPPER DURING ATTACHMENT TO A FILM

[75] Inventors: Paul A. Tilman, New City; Richmond M. Scott, Pleasantville; Zdenek Machacek, Nanuet, all of N.Y.

[73] Assignee: Minigrip, Inc., Orangeburg, N.Y.

[21] Appl. No.: 388,621

[22] Filed: Feb. 14, 1995

Related U.S. Application Data

[63] Continuation-in-part of Ser. No. 249,144, May 25, 1994, Pat. No. 5,462,360, and a continuation-in-part of Ser. No. 337,569, Nov. 10, 1994, which is a continuation-in-part of Ser. No. 174,273, Dec. 28, 1993, Pat. No. 5,368,394.

[51] Int. Cl.[6] ..... B31B 1/90; B65B 33/24

[52] U.S. Cl. ..... 156/66; 493/213; 493/215

[58] Field of Search ..... 156/66; 493/212–215; 24/399, 400, 576, 587; 383/63

[56] References Cited

U.S. PATENT DOCUMENTS

| | | | |
|---|---|---|---|
| 4,372,793 | 2/1983 | Herz | 156/66 |
| 4,498,939 | 2/1985 | Johnson | 156/66 |
| 4,791,710 | 12/1988 | Nocek | 24/587 |
| 4,964,739 | 10/1990 | Branson | 383/63 |
| 5,368,394 | 11/1994 | Scott | 24/587 |

*Primary Examiner*—Daniel Stemmer

*Attorney, Agent, or Firm*—Kane, Dalsimer, Sullivan, Kurucz, Levy, Eisele and Richard, LLP

[57] ABSTRACT

A method for stabilizing and aligning interlocked male and female profiles of a plastic zipper strip during attachment of the strip to a polymeric film requires the use of profiles having stabilizers, perhaps taking the form of wedges. The stabilizers, disposed in pairs on each side of the interlocked male and female members of the profiles, mechanically cooperate with one another to maintain the profiles substantially parallel to one another and incapable of rocking about a longitudinal axis. The stabilizers on the male profile may be inboard, outboard or at the same distance from the interlocked male and female members as their respective stabilizers on the female profile. The facing surfaces of the stabilizers may be inclined so as to provide a wedging action with respect to one another.

7 Claims, 8 Drawing Sheets

METHOD FOR STABILIZING A PLASTIC ZIPPER DURING ATTACHMENT TO A FILM

Cross-Reference to Related Applications

This is a continuation-in-part (CIP) of U.S. patent application Ser. No. 08/249,144, filed May 25, 1994, now U.S. Pat. No. 5,462,360 and of U.S. patent application Ser. No. 08/337,569, filed Nov. 10, 1994, which in turn is a continuation-in-part of application Ser. No. 08/174,273 filed on Dec. 28, 1993, now U.S. Pat. No. 5,368,394

BACKGROUND OF THE INVENTION

1. Field of the Invention

This invention pertains to the art of reclosable plastic bags having extruded zippers, and more particularly to a reclosable bag having fastener profiles including wedge-shaped stops, which facilitate the joining attachment of the fastener profiles and which determine the amount of pull force required to open the bags. The fastener profiles are further of a design which makes inadvertent opening of the bags less likely.

The present invention also relates to reclosable plastic bags requiring a greater pull force to be opened from within than from without, and to a method for substantially reducing the variance in the forces required to open such bags from within and from without, as well as the consequent variability in the ratio between those forces.

The present invention further relates to a method for stabilizing and aligning the profiles of a plastic zipper during its attachment to a sheet of polymeric film, such as that used to make reclosable bags.

2. Description of the Prior Art

Reclosable bags used, for example, for storing household foodstuffs are typically made of polyethylene. As shown in U.S. Pat. No. 3,416,199 to Imamura commonly assigned with the present invention, a reclosable bag may be formed of two opposed walls equipped at the mouth with fastener profiles. These profiles include a male profile attached to one wall and a female profile on the other wall. The profiles are shaped so that, when they are aligned and pressed together into an engaging relationship, they form a continuous closure for the bag. The bag may be opened by pulling the walls apart thereby separating the profiles. Various geometric shapes and arrangements for such profiles are shown in U.S. Pat. Nos. Re. 28,969; 3,323,707; 4,212,337; 4,363,345; 4,561,108; and 4,812,056. In addition, U.S. Pat. Nos. 4,736,496 and 5,012,561 disclose reclosable bags with profiles and internal ribs adjacent to the profiles. U.S. Pat. No. 4,822,539 discloses a reclosable bag with interlocking profiles, internal guiding ribs disposed adjacent to the profiles, and stabilizing beams disposed on the outside surface of the bag wall. U.S. Pat. No. 3,338,285 discloses a reclosable bag having several parallel interlocking male and female profiles. In general, the profiles must be such as to provide relatively high resistance to opening from inside the bag while rendering the bag relatively easy to open from the outside.

For the zipper to function properly, it is important that the zipper components (i.e. the profiles and any wedges, beams, ribs or the like provided to enhance the operation of the profiles) maintain their alignment. The problem of maintaining the alignment of the components of the zipper is exacerbated where the zipper is in string or strip form to be heat sealed to a film material from which the body of the bag is to be formed, since the heat necessary to fuse the zipper strip to the film could distort the profiles or a zipper component. Heretofore, the problem has been avoided by adding webs to the zipper strip to separate the profiles (and components) from the point of attachment to the film. In U.S. Pat. No. 4,673,383 a zipper strip is disclosed having fusible ribs on its undersurface to minimize the heat to which the zipper is subjected. In U.S. Pat. Nos. 4,691,372; 4,731,911; and 4,817,188, an adhesive layer is provided on the base of the profile portion of the strip.

Another aspect of the problem of maintaining the alignment of the components during heat-sealing to a film material is reflected in the ability of the profiles to rock relative to one another about a longitudinal axis because a male interlocking member may pivot within a female interlocking member about such an axis. This ability to rock or pivot presents an instability of the two profiles relative to one another which may have an adverse effect on the quality of the heat-seal between the profiles and the film material.

SUMMARY OF THE INVENTION

In view of the above, an objective of the present invention is to provide a reclosable bag with improved closure means resistant to inadvertent opening.

Another object is to provide such closure means in the form of a zipper strip which may be heat-sealed to an associated film without distorting the zipper profiles or any of the components of the zipper.

Yet another object of the present invention is to provide a method for stabilizing and aligning interlocked male and female profiles of a plastic zipper strip during attachment of the strip to a polymeric film to eliminate or substantially reduce the freedom of the profiles to rock relative to one another about a longitudinal axis and the consequent loss of uniformity and consistency in the heat-seal between the profiles and the polymeric film.

Other objectives and advantages of the invention will become apparent from the following description. A reclosable bag constructed in accordance with this invention includes a front wall and a rear wall joined to form an enclosure with a mouth defined by wall edges at the top of the bag and male and female profile means having male and female members for selectively opening and closing said mouth. Stabilizer wedges are provided on each of the male and female profile means. Specifically, a stabilizer wedge is provided on each side of the male and female members on the male and female profile means. The wedges keep the zipper parallel during the application of the zipper to the film from which the bag is made and have a stabilizing effect during the attachment process. Further, the wedge action controls the force required to open the bag, and substantially increases the inside resistance to opening pressure from the product within the bag. Finally, the stabilizer provides the zipper as a whole with a wide-track feel for the benefit of the consumer.

The profiles are provided on zipper strips heat-sealed to the front and rear walls of the bag. To facilitate the heat-sealing, a layer of a material having a lower melting temperature than the zipper strips and the bag material is provided underlying at least a portion of the zipper strip width so that the zipper may be heat-sealed to the bag walls at a temperature sufficiently low to prevent distortion of the profiles or wedges, or of the bag material. The lower-melting-point material may underlie only a portion of the zipper width, so that a hinged connection is provided between the zipper strip and bag wall. The lower-melting-point material may, for example, be a high ethylene-vinyl acetate (EVA) material, a high melt index (M.I.) material, a thermoplastic olefin (TPO) copolymer or polypropylene-ethylene copolymer, or an ethylene methyl acrylate (EMA) copolymer.

The use of a lower-melting-point material under only a portion of the zipper may enable the manufacturer to fix the position of the seal of the zipper strip to the bag wall in spite of any lateral shifting, or "float", thereof permitted by the equipment used to manufacture the bags. Such is accomplished by making the lower-melting-point material in a strip wider than the "float" which may occur in the equipment. In that situation, the lower-melting-point material will be melted by the sealing head, regardless of any shift laterally relative thereto, and will ensure a seal at a constant position on the profile.

The present method for stabilizing and aligning interlocked male and female profiles of a plastic zipper strip during attachment of the strip to a polymeric film includes the step of providing a first profile having a first base with first and second surfaces. A male interlocking member and a pair of first stabilizers, one on each side of the male interlocking member, are provided on the first surface of the first base.

Also provided is a second profile having a second base with first and second surfaces. A female interlocking member and a pair of second stabilizers, one on each side of the female interlocking member, are provided on the first surface of the second base.

When the first and second profiles are joined together by interlocking their respective male and female interlocking members, each one of the pair of first stabilizers on the first profile is brought into a position substantially adjacent to one of the pair of second stabilizers on the second profile. The adjacent ones of the first and second stabilizers on each side of the interlocked male and female interlocking profiles cooperate to maintain the second surface of the first base substantially parallel to the second surface of the second base and to prevent the profiles from rocking relative to one another about a longitudinal axis. The first stabilizers may be inward of, outward of, or at the same distance from the interlocked male and female interlocking profiles compared to their respective second stabilizers.

Each one of the pair of first stabilizers is contacted with its respective one of the pair of second stabilizers while the second surfaces of the first and second bases of their respective profiles are attached to polymeric sheet material, so that the sheet material will be attached to the second surfaces in a consistent and uniform manner as a result of the substantial parallelism of the second surfaces of the profiles brought about by the mechanical cooperation between the stabilizers.

The present invention will now be described more completely with frequent reference being made to the drawings identified hereinbelow.

DETAILED DESCRIPTION OF THE PREFERRED EMBODIMENT

Figure 2:
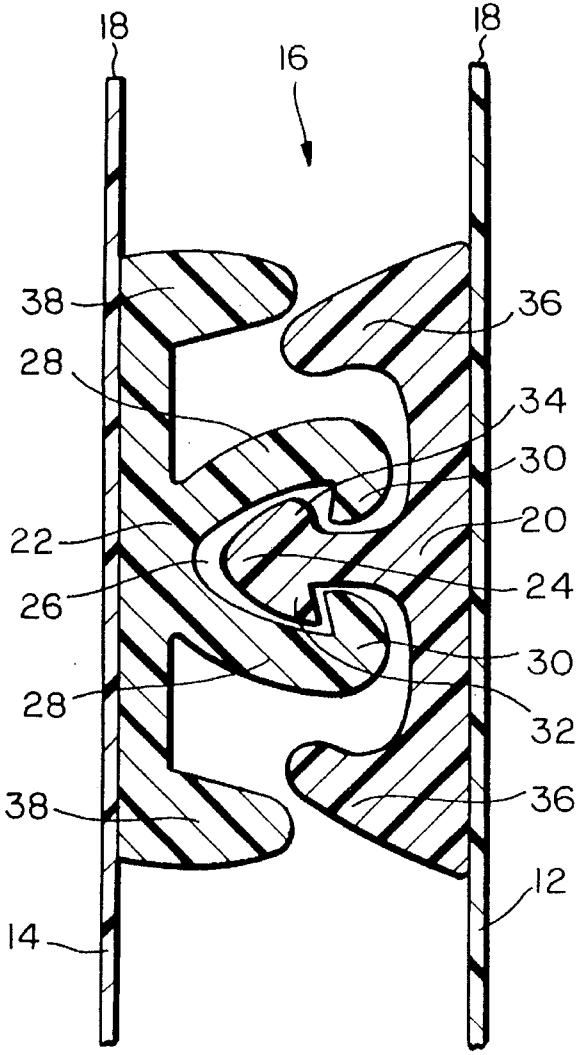
FIG. 2 shows an enlarged side sectional view of the bag opening.
Figure 1:
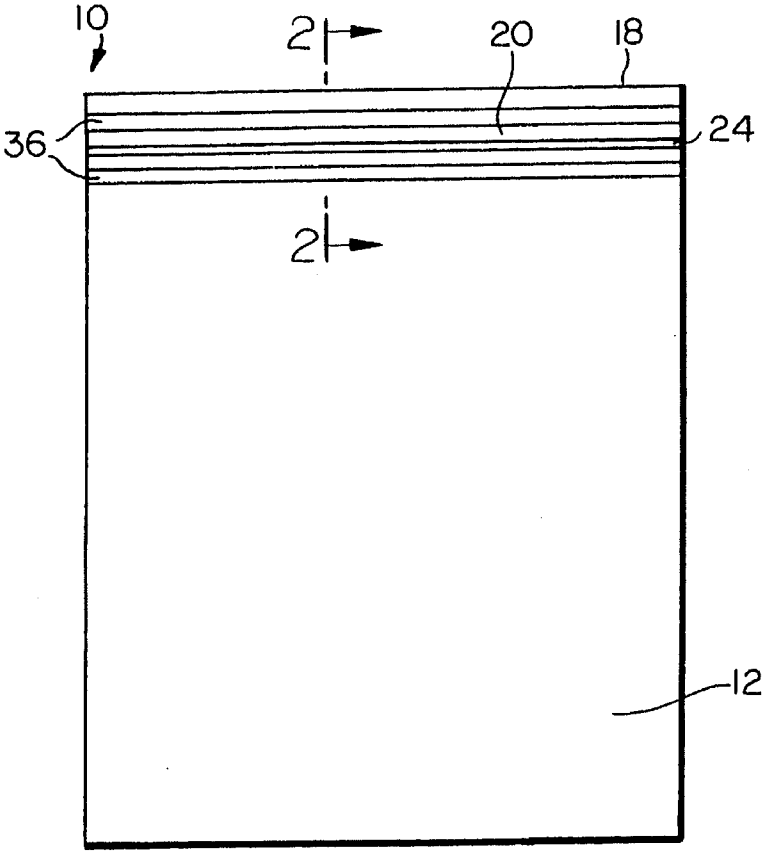
FIG. 1 shows a plan view of a reclosable bag constructed in accordance with the present invention.

Referring now to the drawings, and specifically to FIGS. 1 and 2, a reclosable bag 10 constructed in accordance with this invention includes front and rear walls 12,14 seamed along three edges thereby forming an enclosure with an opening or mouth 16 along the top or fourth edge 18. The bag 10 is preferably made of a thermoplastic material such as polyethylene by extrusion. Attached to internal faces, walls 12 and 14 are male and female profiles 20,22 respectively, which extend continuously from side to side of the bag. The profile serves to close the bag opening 16 when they are interlocked as shown in FIG. 2.

The male profile 20 includes an asymmetric arrowhead 24 which locks into a channel 26 formed by two inwardly curved members 28 having inwardly pointing stubs 30. The asymmetric arrowhead 24 is so called because its two barbs are not mirror images of one another. Barb 32 has an acute edge, while barb 34 has a rounded edge. Barb 34 is closer to the mouth 16 of the bag 10 than barb 32.

The male profile 20 has two stabilizer wedges 36, which are on each side of the asymmetric arrowhead 24 and are parallel thereto across the width of the bag 10. The stabilizer wedges 36 are inclined toward one another and toward asymmetric arrowhead 24.

In like manner, the female profile 22 has two stabilizer wedges 38, which are on each side of the inwardly curved members 28 and are parallel thereto across the width of the bag 10. The stabilizer wedges 38 are inclined away from one another, or, at least, have surfaces facing the inwardly curved members 28 which are inclined away from one another.

When the male and female profiles 20,22 are interengaged as shown in FIG. 2, stabilizer wedges 36 protrude to some preselected degree into the spaces between the stabilizer wedges 38 and the inwardly curved members 28 on the female profile 22.

Figure 3:
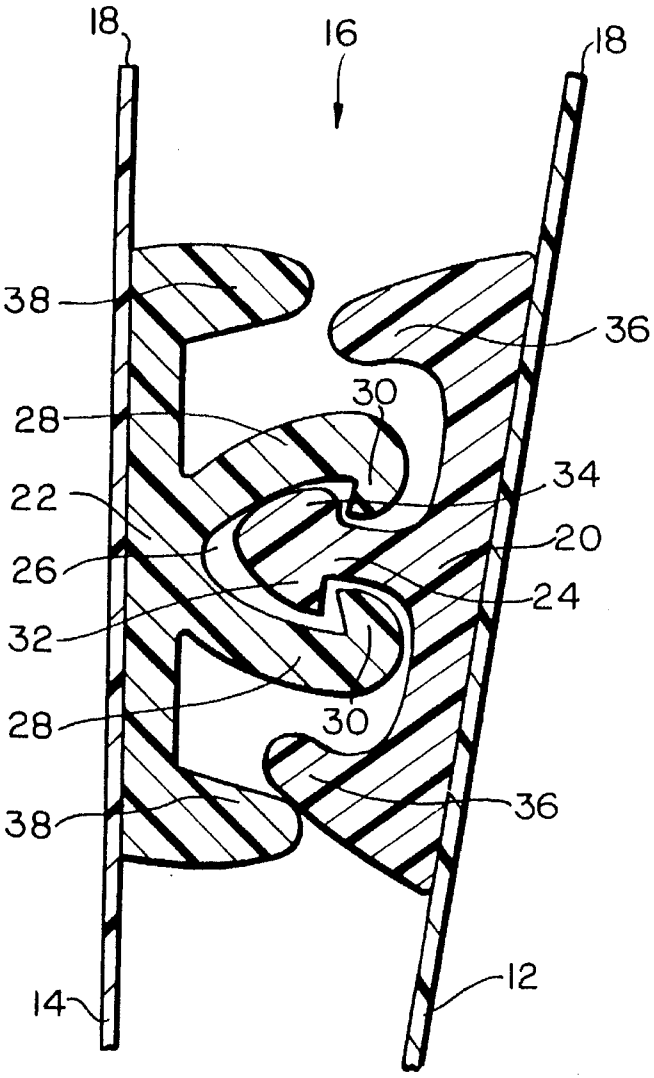
FIG. 3 shows an enlarged side sectional view, analogous to that presented in FIG. 2, of the bag being opened from the outside.

Bag 10 is normally opened by gripping edges 18 on the outside of the bag 10 and pulling them apart. In response to such action the lower stabilizer wedges 36,38, which are toward the inside of the bag 10, as shown in FIG. 3, abut against one another. This braces the male profile 20 against the female profile 22, and allows the rounded barb 34 of the asymmetric arrowhead 24 to glide past its adjacent stub 30 to open the bag 10. The force required to open the bag 10 may be preselected by appropriately choosing the angles at which the surfaces of stabilizer wedges 36,38 contact one another.

Figure 4:
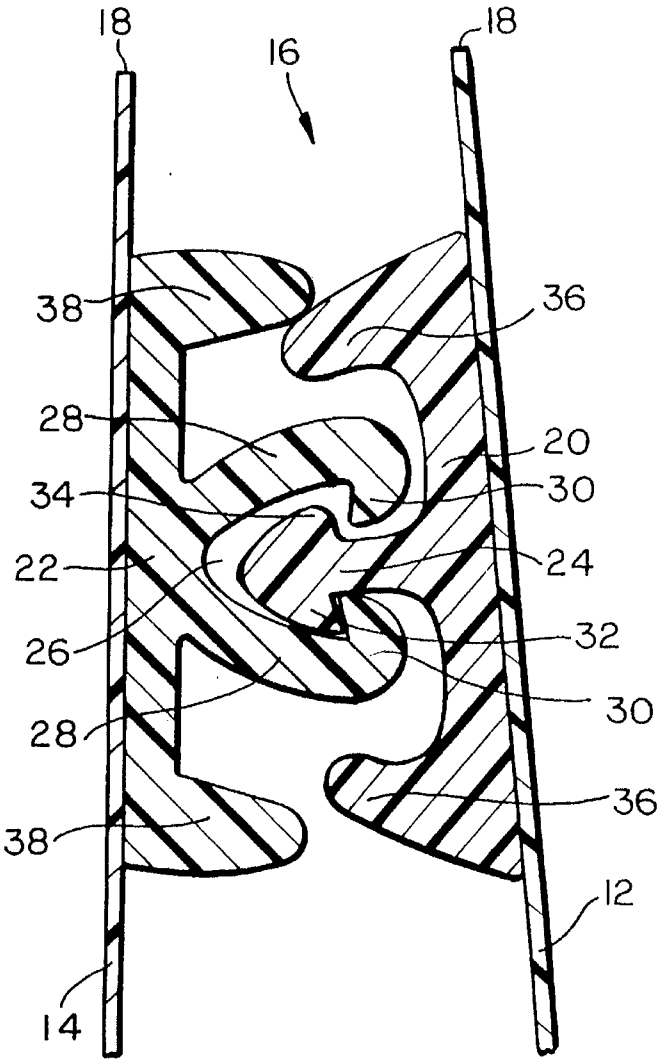
FIG. 4 shows another enlarged side sectional view, analogous to that presented in FIG. 2, of the bag being opened from the inside.

The situation that would arise from an opening force from within the bag 10 is shown in FIG. 4. In response to such action, the upper stabilizer wedges 36,38, which are toward the outside of the bag 10, as shown in FIG. 4, abut against one another. This again braces the male profile 20 against the female profile 22, and hooks the acute barb 32 of the asymmetric arrowhead 24 behind its adjacent stub 30 inhibiting the opening of the bag 10. The force required to open the bag 10 from within may be preselected by appropriately choosing the angles at which the surfaces of stabilizer wedges 36,38 contact one another.

Bag 10 may be generated unitarily, for example, by extruding the walls 12,14, and the profiles 20,22 integrally. Alternatively, the closures may be extruded separately, and then may be bonded to sheets of bag forming material at some stage in the bag forming operation.

Figure 5:
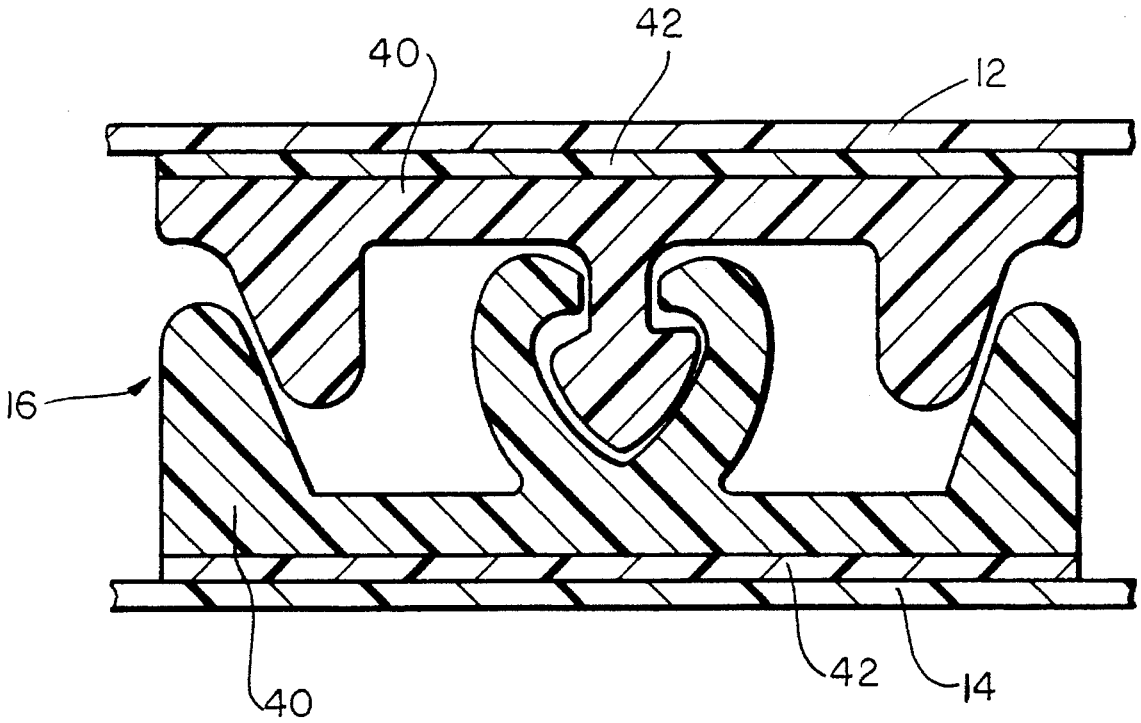
FIG. 5 shows an enlarged side sectional view of an alternative embodiment of the bag of the present invention wherein an interlayer is utilized between the bag walls and profile strips.
Figure 6:
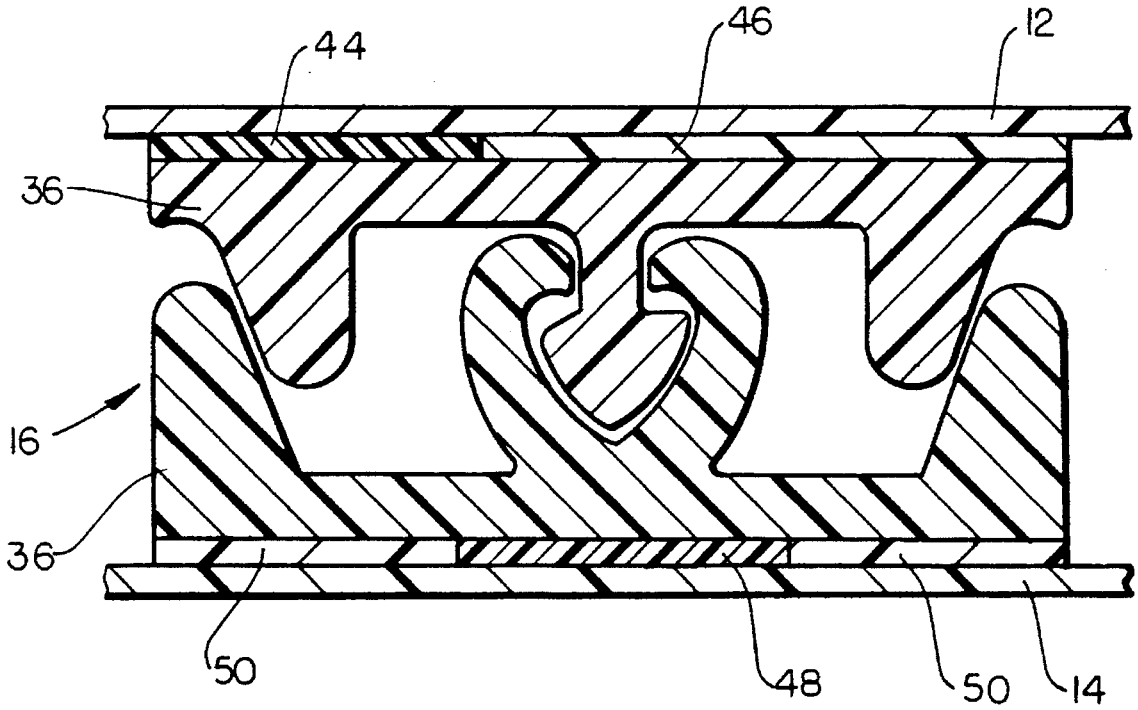
FIG. 6 shows an enlarged side sectional view of a further embodiment of the bag of the present invention.

The construction of the zippers shown in FIGS 5 and 6 is the same as that described above except that in each case an intermediate layer 42 is provided between the base 40 of the profile strips and the bag walls 12,14. The intermediate layer 42 comprises, at least in part, a material having a lower melt temperature than the base of the profile strip and the bag material. For example, the material of the intermediate layer 42 may have a higher EVA content or a higher melt index. Thus, in FIG. 5, the zipper and bag material may be formed of a relatively low melt index material, such as a conventional polyethylene, whereas the intermediate layer 42 may be formed of a high EVA content polyethylene, or may be provided of a relatively high melt index polyethylene material such as sold by Quantum Chemical Co. under the tradename NATR 201, the melt index of the latter being 6 as compared with a melt index of 2 for the conventional polyethylene resin from which the zipper is formed. Those of ordinary skill in the art understand the melt index (M.I.) of a thermoplastic material to be the amount, in grams, which can be forced through an orifice of 0.0825 inch diameter when subjected to a force of 2160 grams in ten minutes at a temperature of 190° C. under the procedure set forth in ASTM Standard D-1238.

Those of ordinary skill in the art will also recognize that the inclusion of intermediate layer 42 having a lower melting point than the base 40 of the profile strips and the bag walls 12,14 may permit the profile strips to be bonded to the bag walls 12,14 at a lower temperature than that which would be required to bond them directly to one another. As a consequence, distortion of the profile strips, caused by exposure to temperatures near the melting point of the polyethylene from which they may be extruded, as well as a thinning of the bags walls 12,14 in the areas where the bonding is being carried out, may be avoided through the use of a lower-melting-point intermediate layer of this type.

In the embodiment of FIG. 6, on the male profile side of the zipper the lower-melting-point material 44 of the interlayer is provided behind only a portion of the zipper carrying the male profile. The lower-melting-point material 44 extends downwardly (i.e. toward the bag bottom) from the top edge of the zipper substantially behind the top wedge 36. The lower portion 46 of the interlayer (i.e. behind the male profile and bottom wedge) is formed of a non-seal material (i.e. a material that will not fuse to the bag wall at the temperature at which the top portion 44 of the interlayer is fused to the bag wall). As a result the male profile strip will be hinged to the bag wall to enhance the resistance to opening of the bag from within the bag in the manner described in U.S. Pat. No. 4,430,070. The lower-melting-point material 48 of the female profile strip is disposed behind the female profile and strips 50 formed of non-seal material are provided above and below the female profile as shown. As above, the lower-melting-point material 44,48 may be a high EVA material or a high melt index material.

In general, interlayers of the variety shown in FIG. 6 may be used to overcome the variability in the forces required to open reclosable plastic bags caused by the floating of the zipper profiles laterally with respect to the sealing heads in the apparatus commonly used to bond the zipper profiles to plastic sheet material.

Figure 7:
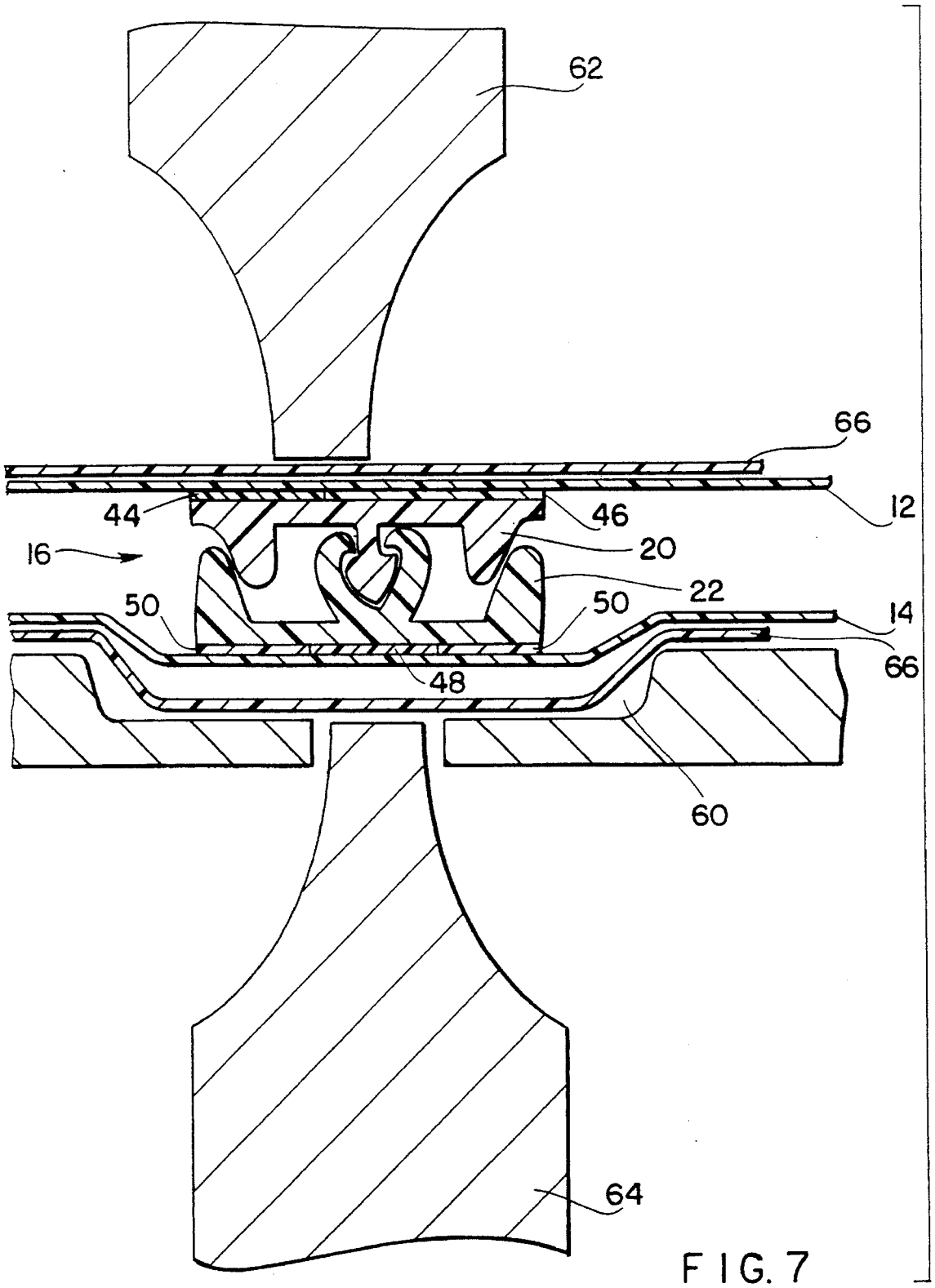
FIG. 7 is a cross-sectional view of an apparatus used to seal zipper profiles to plastic sheet material.

Reference is made to FIG. 7, which shows, in part, a pair of interlocked zipper profiles like those shown in FIG. 6, although it should be understood that the discussion to follow is applicable to zipper profiles of any configuration.

When being bonded to bag walls 12,14, the interlocked male profile 20 and female profile 22 shown in FIG. 6 are passed along a channel 60 between two sealing heads 62,64. It will be recognized that FIG. 7 is a cross-sectional view of the apparatus used to effect the bonding, and that the profiles 20,22 and bag walls 12,14 are moving either toward or away from the observer between the sealing heads 62,64. Slippery, heat-resistant belts 66, of a material such as TEFLON®, are disposed and run between sealing head 62 and bag wall 12, and between sealing head 64 and bag wall 14 to ensure that the bag walls 12,14 will slip freely by the sealing heads 62,64 at the high speeds at which the sealing apparatus operates, and that any material of the bag walls 12,14 that may melt will not accumulate on the sealing heads 62,64.

Because channel 60 must be wide enough to accommodate the female profile 22, bag wall 14 and a TEFLON® belt 66, as shown in FIG. 7, there will inevitably be some lateral shifting, or "float", of the profiles 20,22 within the channel 60, as the profiles 20,22 move longitudinally therein between the sealing heads 62,64. As a consequence, the sealing positions of bag wall 12 to male profile 20, and of bag wall 14 to female profile 22 in the prior art tend to wander laterally across the male and female profiles 20,22. As a consequence of this wandering, the forces required to open the bags from within and from without tend to be nonuniform. This is particularly true where only a portion of the width of the profiles 20,22 is to be bonded to their respective bag walls 12,14, as was the case in FIG. 6.

However, the present invention provides a method for overcoming this variability, which is often unacceptable to the end users of the bags being produced. The key is to provide lower-melting-point material 44,48 in the regions where a bond is desired in a width such that, despite any lateral shifting, or "float", of the profiles 20,22 within the channel 60, a portion of the lower-melting-point material 44,48 is always adjacent to its respective sealing head 62,64. In other words, lower-melting-point material 44,48 is provided in greater widths than any "float" in either lateral direction, so that the sealing heads 62,64 are always adjacent to lower-melting-point material 44,48, melt it, and produce a bond which does not wander longitudinally in a given bag, or from one bag to another.

Stated somewhat differently, the lower-melting point material 44,48 provides selectively placed preferential seal areas. When float or lateral shifting of the profiles occurs, the bond is confined to the preferential seal area. The non-seal areas, defined by portions 46,50, ensure that bonding does not occur in those areas which will adversely effect the pull test requirements for the pouch or package.

Figure 8C:
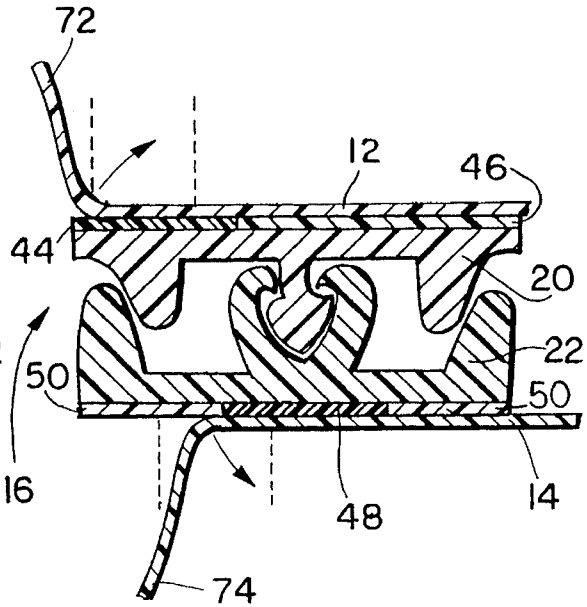
FIGS. 8A, 8B and 8C show pull test conditions for measuring the force required to open plastic bags from without.
Figure 8B:
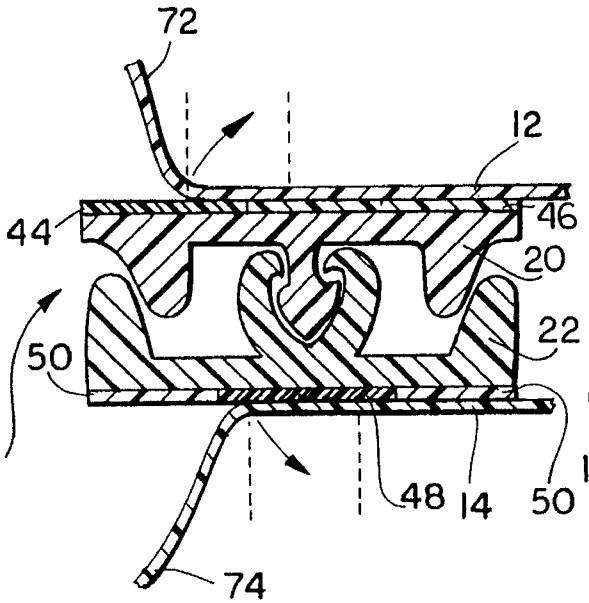
Figure 8A:
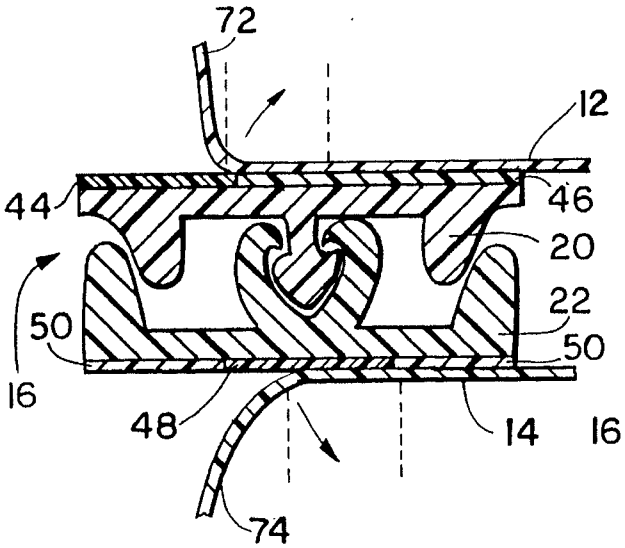

For purposes of illustration, reference will now be made to FIGS. 8A, 8B and 8C, which show pull test conditions for measuring the force required to open plastic bags from without, that is, from outside, corresponding to an intentional opening by a consumer. FIGS. 8A, 8B and 8C represent the conditions where the interlocked male and female profiles 20,22 have been attached to the bag walls 12,14, respectively, by passing between sealing heads 62,64 on the left side, center and right side of channel 60 in FIG. 7. In each case, the dashed lines above and below the interlocked male and female zipper profiles 20,22 represent the positions of sealing heads 62,64. As such, FIGS. 8A, 8B and 8C represent the effect of the float of the interlocked male and female zipper profiles 20,22 to the left and to the right within channel 60.

Recalling that sealing head 62 only seals lower-melting-point material 44 to bag wall 12, and that sealing head 64 only seals lower-melting-point material 48 to bag wall 14, it will be readily understood that, when point 72 of bag wall 12 and point 74 of bag wall 14 are pulled apart to conduct the pull test from without, the results are substantially the same for FIGS. 8A, 8B and 8C. That is because, in each case, point 72 pulls the male profile 20 outwardly of its interlocking with female profile 22, while point 74 pulls from behind the interlocking point between the male and female profiles 20,22. In each case, the rounded portion of the arrowhead of male profile 20 simply slips out of the channel in the female profile 22.

Figures 9A, 9B, 9C:
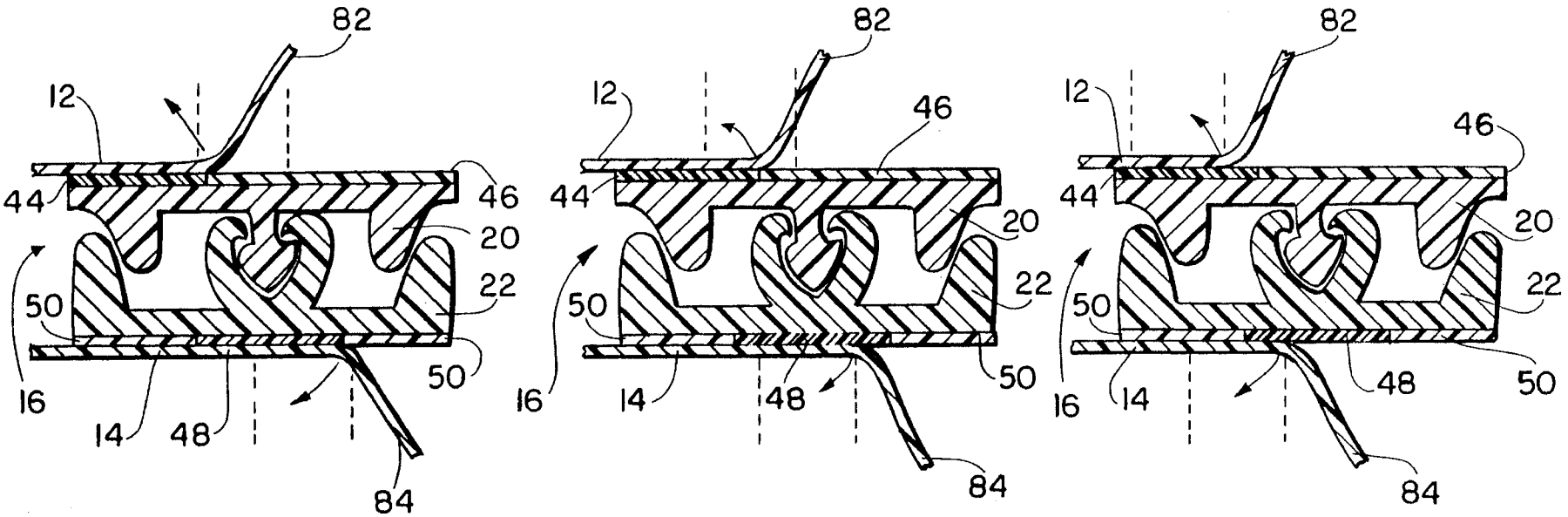
FIGS. 9A, 9B and 9C show pull test conditions for measuring the force required to open plastic bags from within.

In contrast, FIGS. 9A, 9B and 9C show pull test conditions for measuring the force required to open plastic bags from within, that is, from inside the bag, corresponding to an unintentional opening of the bag from inside. Again, the dashed lines above and below the interlocked male and female profiles 20,22 represent the positions of sealing heads 62,64. As such, FIGS. 9A, 9B and 9C represent the effect of the float of the interlocked male and female zipper profiles 20,22 to the left and to the right within channel 60.

Recalling again that sealing head 62 only seals lower-melting-point material 44 to bag wall 12, and that sealing head 64 only seals lower-melting-point material 48 to bag wall 14, it will be readily understood that, when point 82 of bag wall 12 and point 84 of bag wall 14 are pulled apart to conduct the pull test from within a bag, the results are substantially the same for FIGS. 9A, 9B and 9C. That is because, in each case, point 82 pulls the male profile 20 outwardly of its interlocking with female profile 22, while point 84 pulls from behind the interlocking point between the male and female profiles 20,22. In each case, the acute portion of the arrowhead of male profile 20 ensures that it remains locked within the channel in the female profile 22.

Figure 10:
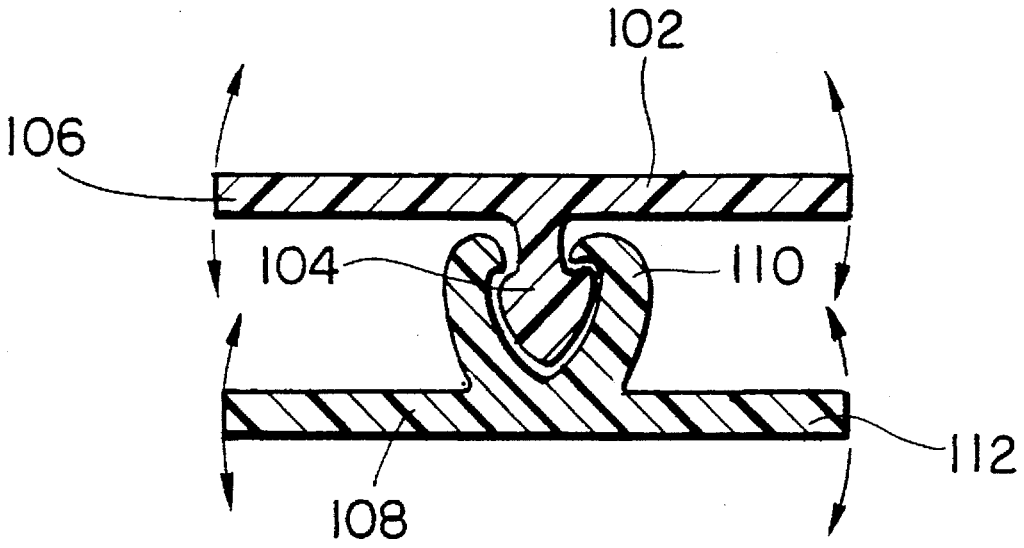
FIG.10 PRIOR ART
FIG. 10 is a cross-sectional view of a pair of interlocked zipper profiles of the prior art.

Now, turning to FIG. 10, a cross-sectional view of a pair of interlocked zipper profiles of the prior art is shown to illustrate the problems which may arise from the ability of the profiles to rock relative to one another about a longitudinal axis. A male profile 102 comprises a male interlocking member 104 on a first base 106, while a female profile 108 comprises a female interlocking member 110 on a second base 112. The first base 106 and second base 112 are unstabilized and can rock about a longitudinal axis perpendicular to the figure. This potential for rocking has been observed to cause problems during the attachment of polymeric film to the bases 106, 112, because they are not physically maintained parallel to one another.

Figure 11:
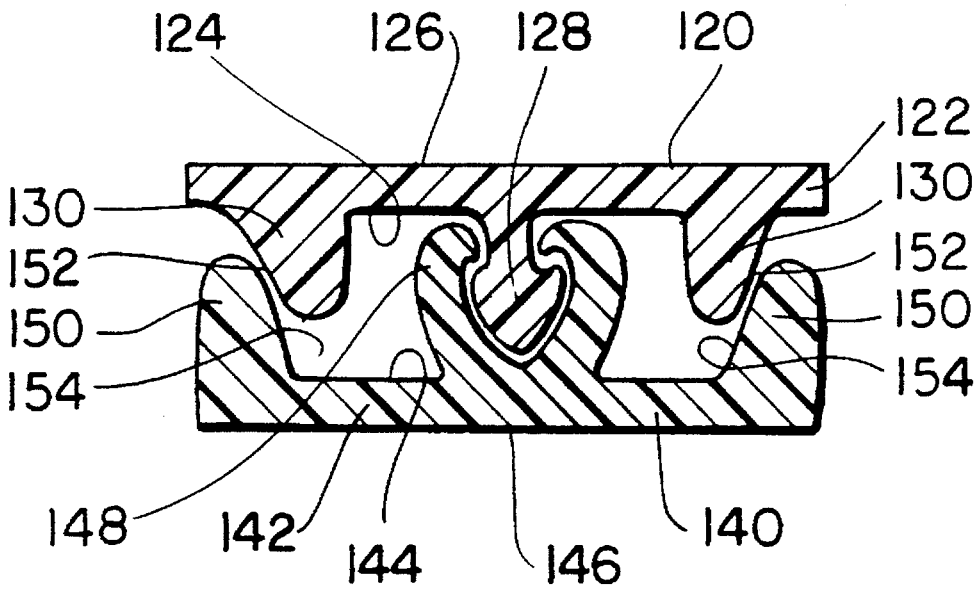
FIG. 11 is a cross-sectional view of a pair of interlocked zipper profiles which may be used in the practice of the present invention.

FIG. 11 shows one embodiment of a pair of interlocked zipper profiles which may be used in the practice of the present invention A first profile 120 has a first base 122 with a first surface 124 and a second surface 126. A male interlocking member 128 and a pair of first stabilizers 130, one on each of the two sides of the male interlocking member 128, on the first surface 124 of the first base 122.

A surface profile 140 has a second base 142 with a first surface 144 and a second surface 146. A female interlocking member 148 and a pair of second stabilizers 150, one on each of the two sides of the female interlocking member 148, on the first surface 144 of the second base 142.

When the first profile 120 and the second profile 140 are joined to one another as shown in FIG. 11 by interlocking male interlocking member 128 with female interlocking member 148, the second surface 126 of first base 122 and the second surface 146 of second base 142 are maintained in a substantially parallel condition by first stabilizers 130 and second stabilizers 150.

Figure 12:
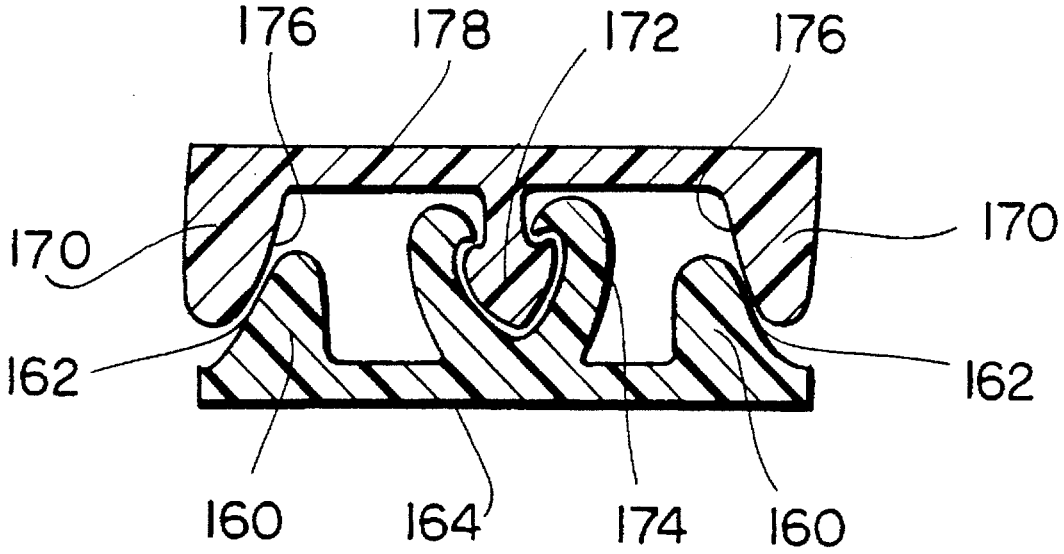
FIG. 12 is a cross-sectional view of an alternate embodiment pair of interlocked zipper profiles which may be used in the practice of the present invention.

In FIG. 11, the first stabilizers 130 are inward of their respective second stabilizers 150 with respect to the male interlocking member 128 and female interlocking member 148. In FIG. 12, which shows an alternate embodiment pair of interlocked zipper profiles which may be used in the practice of the present invention, second stabilizers 160 are inward of their respective first stabilizers 170 with respect to the male interlocking member 172 and female interlocking member 174. And further, in FIG. 13, which shows a third embodiment pair of interlocked zipper profiles which may be used in the practice of the present invention, first stabilizers 180 and second stabilizers 190 are equidistant from male interlocking member 192 and female interlocking member 194.

In the first embodiment, that shown in FIG. 11, each of the first stabilizers 130 has a surface 152 inclined inwardly with respect to the interlocked male interlocking member 128 and female interlocking member 148. In like manner, each of the second stabilizers 150 has a surface 154 inclined outwardly with respect to the interlocked male and female members 128,148. The surfaces 152,154 are adjacent to one another and provide a wedging action therebetween to maintain second surfaces 126,146 parallel to one another.

In the second embodiment, which is shown in FIG. 12, each of the first stabilizers 170 has a surface 176 inclined outwardly with respect to the interlocked male interlocking member 172 and female interlocking member 174. In like manner, each of the second stabilizers 160 has a surface 162 inclined inwardly with respect to the interlocked male and female members 172,174. The surfaces 162,176 are adjacent to one another and provide a wedging action therebetween to maintain second surfaces 164,178 parallel to one another.

Figure 13:
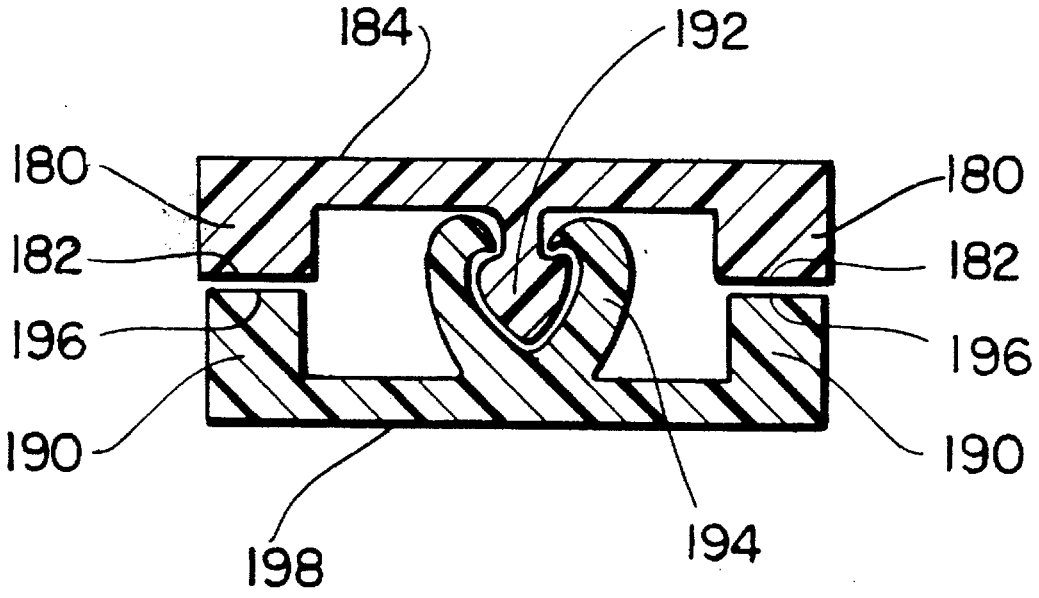
FIG. 13 is a cross-sectional view of a third embodiment pair of interlocked zipper profiles which may be used in the practice of the present invention.

Finally, in the third embodiment, shown in FIG 13, each of the first stabilizers 180 has an abutting surface 182 and each of the second stabilizers 190 has an abutting surface 196. The surfaces 182,196 are adjacent to one another when male interlocking member 192 is interlocked with female interlocking member 194 to provide an abutting action therebetween to maintain second surfaces 184,198 parallel to one another.

Obviously, numerous modifications may be made to this invention without departing from its scope as defined in the appended claims.

What is claimed is:

1. A method for stabilizing and aligning interlocked male and female profiles of a plastic zipper strip during attachment of the strip to a polymeric film comprising the steps of:

providing a first profile having a first base with first and second surfaces, said first profile having a male interlocking member and a pair of first stabilizers, one on each of two sides of said male interlocking member, on said first surface of said first base thereof;

providing a second profile having a second base with first and second surfaces, said second profile having a female interlocking member and a pair of second stabilizers, one on each of two sides of said female interlocking member, on said first surface of said second base thereof;

joining said first and second profiles together by interlocking their respective male and female interlocking members to bring each one of said pair of first stabilizers on said first profile into a position substantially adjacent to one of said pair of second stabilizers on said second profile and to maintain said second surface of said first base substantially parallel to said second surface of said second base; and contacting each one of said pair of first stabilizers with its respective one of said pair of second stabilizers while attaching said second surfaces of said first and second bases of said first and second profiles, respectively, to polymeric sheet material, so that said sheet material will be attached thereto in a consistent and uniform manner as a consequence of the substantial parallelism of said second surfaces.

2. A method as claimed in claim 1 wherein each one of said pair of first stabilizers is inward of its respective one of said pair of second stabilizers with respect to said interlocked male and female interlocking members.

3. A method as claimed in claim 2 wherein each one of said pair of first stabilizers has a surface inclined inwardly with respect to said interlocked male and female interlocking members and each one of said pair of second stabilizers has a surface inclined outwardly with respect to said interlocked male and female interlocking members, said inclined surfaces of said first stabilizers being adjacent to said inclined surfaces of their respective second stabilizers in order to provide a wedging action therebetween.

4. A method as claimed in claim 1 wherein each one of said pair of second stabilizers is inward of its respective one of said pair of first stabilizers with respect to said interlocked male and female interlocking members.

5. A method as claimed in claim 4 wherein each one of said pair of second stabilizers has a surface inclined inwardly with respect to said interlocked male and female interlocking members and each one of said pair of first stabilizers has a surface inclined outwardly with respect to said interlocked male and female interlocking members, said inclined surfaces of said second stabilizers being adjacent to said inclined surfaces of their respective first stabilizers in order to provide a wedging action therebetween.

6. A method as claimed in claim 1 wherein each one of said pair of first stabilizers and its respective one of said pair of second stabilizers are equidistant from said interlocked male and female interlocking members.

7. A method as claimed in claim 6 wherein each one of said pair of first stabilizers has an abutting surface and each one of said pair of second stabilizers has an abutting surface, said abutting surfaces of said first stabilizers being adjacent to said abutting surfaces of their respective second stabilizers in order to provide an intimate abutting contact therebetween.

* * * * *